US006176064B1

(12) United States Patent
Janelle

(10) Patent No.: US 6,176,064 B1
(45) Date of Patent: Jan. 23, 2001

(54) APPARATUS AND METHOD FOR FORMING FLASHING

(76) Inventor: David Janelle, 74 Mcevoy Dr., Auburn, NH (US) 03032

( * ) Notice: Under 35 U.S.C. 154(b), the term of this patent shall be extended for 0 days.

(21) Appl. No.: 09/293,441

(22) Filed: Apr. 16, 1999

(51) Int. Cl.[7] ..... E04F 21/00

(52) U.S. Cl. ..... 52/749.1; 72/253.1; 72/255; 72/274; 72/275; 72/468

(58) Field of Search ..... 52/749.1; 72/253.1, 72/255, 274, 275, 467, 468

(56) References Cited

U.S. PATENT DOCUMENTS 1,713,742 * 5/1929 Challet ..... 72/275 X
1,909,930 * 5/1933 Ridder ..... 72/166
3,495,506 * 2/1970 Plymale ..... 72/468 X
3,782,164 * 1/1974 Felker ..... 72/274 X
3,895,467 7/1975 Clement .
5,611,237 * 3/1997 Harper ..... 72/458

* cited by examiner

*Primary Examiner*—Christopher T. Kent
(74) *Attorney, Agent, or Firm*—Mesmer & Deleault, PLLC

(57) ABSTRACT

A device for forming flashing, and a method for forming the same for adaptation to freeze boards. The present invention is a device for forming flashing comprising a plate with at least one groove cut through the plate. The groove in the plate has at least one angle changing the groove from a first direction to a second direction on the plate. The grooves may be organized in V-shape or Z-shape arrangements. Flashing is inserted into the groove, bending the sheet metal to take on the form of a similar shape to the groove. The flashing is then pulled through the device, creating a uniform bend along the length.

18 Claims, 4 Drawing Sheets

APPARATUS AND METHOD FOR FORMING FLASHING

BACKGROUND OF THE INVENTION

I. Field of the Invention

The present invention relates to flashing. More particularly, the present invention relates to flashing and a method for forming the same. Even more particularly, the present invention relates to a method for forming flashing for adaptation to freeze boards.

II. Description of the Prior Art

Flashing is a building material that is employed to prevent water seepage into a home or other building. Metallic flashing is sold in rolls or sheets of sheet metal thin enough to allow a builder to cut, form and modify sections of the flashing for different applications. Generally, a builder will take the roll of sheet metal and cut it to a desired length. At that point, the cut length is formed to a required angle by pounding the sheet metal against the corner of a board, or it is manually bent.

For example, a builder is generally required to manually bend flashing around each window casing. To accomplish this task, flashing is cut to the desired length, then formed by placing the flashing up against the casing, and hit with a hammer until the flashing takes the form of the casing or board. This process is often slow and labor intensive. Moreover, manually forming an angle, in even moderate lengths of flashing, seldom provides a uniform angle across the entire length.

Some companies, acknowledging the fact that forming flashing at a building or remodeling site is very time consuming, pre-form specialized flashing pieces at a factory or shop. Most pre-formed flashing is formed by a method of pressing or stamping. An apparatus and method for pre-forming flashing for roof vent pipes is illustrated by U.S. Pat. No. 3,895,467 (1975, C. Clement). The flashing is formed by pressing a role of sheet metal with a male die against a female die thereby taking on the shape of the dies. Additionally, each die set will make one flashing piece at a time. This device will work well in an assembly line set up, creating numerous pieces by feeding the roll through the set of dies. Unfortunately, stamping out pieces is only economical in a manufacturer setting. The apparatus is too big to move around from site to site the way a builder moves.

What is needed is a device that is inexpensive to manufacture, and small enough to be able to be moved from site to site. What is also needed is a device that is compact and that it is easily stored and set up. In addition, the device should be capable of forming angles along an entire roll of flashing, to an entire length of pre-cut flashing or to portions of a roll or cut piece of flashing. What is further needed is a device to form multiple angles in flashing, including a Z-shaped angle. Z-shape angles in flashing are commonly used on the top of window and door casings and comprise a flashing member having two substantially perpendicular angles, with each of the three segments of the flashing having a variable length as appropriate for the task. Additionally, the device should be able to accommodate forming a variety of angles at different lengths and sizes of flashing.

SUMMARY OF THE INVENTION

It is therefore an object of the present invention to provide an apparatus that is inexpensive to manufacture, and is capable of forming flashing to various angles. It is another object of the present invention to provide an apparatus that is capable forming flashing to various angles, and small enough to be able to be moved from site to site. It is still another object of the present invention to provide a device that is capable of forming flashing to various angles, and compact so that it is easily stored and set up. It is yet another object of the present invention to provide a device that is capable of forming flashing to various angles along an entire length of sheet metal or in small sections of flashing material. It is yet another object of the present invention to provide an apparatus that is capable of forming multiple angles in flashing at different lengths and sizes, including a Z-shaped angle.

The present invention achieves these and other objectives by providing a device that is capable of forming flashing to various angles, and is compact and easy to set up. The present invention is a device for forming flashing comprising a plate with at least one groove cut through it. Additionally, the groove in the plate has at least one angle changing the groove from a first direction to a second direction on the plate. (For example, if only one angle was to be used, the groove would be in the form of a V-shape.) The flashing is manually shaped at one end to an angle approximating the angle of the groove in the device and then inserted into the groove. The flashing is then pulled through the device creating a uniform bend along the length flashing passing through the device.

In one embodiment of the present invention the device also includes at least one adjustable guide slidably attached to the groove. The guide provides support to the flashing as it passes through the groove. This guide may be combination of a bolt and nut, a shaft with latches to fix it in a given position, a clamp, or any other device known in the art that would provide an adjustable guide for a groove.

The device may also include, as shown in one embodiment, a measuring means in-line with the groove. Some examples of a measuring means may include a scale, measuring tape, tick marks (indented or raised), or any other means known in the art for measuring a linear distance along a groove. The measuring device may be integrated into the plate or attached to the plate by some other means.

Another embodiment of the present invention includes at least one groove wherein the angle forms a Z-shape. Z-shaped angles in flashing are commonly used by builders. The angle may also be sized to form the flashing to an applied window casing. Additionally, the angle may be sized to form the flashing to an applied door casing. Furthermore, the angle may be sized to substantially fit a three-quarter inch window and freeze board flashing, a one-inch freeze board flashing, or other size freeze board flashing.

Another embodiment of the present invention further comprises a means for supporting shaping plate. This is achieved by attaching the shaping plate to rigid structure such as a building's frame structure. The frame structure gives the device support to prevent movement while pulling the flashing though a groove in the shaping plate. Examples of a means for attaching may include at least one clamp, webbing, string, rope, blocks, adhesive, or any other means for attaching known by one skilled in the art. The device may also include at least one aperture, which preferably would be placed around the perimeter of the shaping plate. The aperture would further expand the means for attaching to include nails, screws, bolts, pegs, anchors, or any other device that could be used to attach a plate to a support structure through an aperture.

The device for forming flashing may also include varying thickness in the groove. The groove may vary between approximately ⅛ inch thick to approximately 1/16 inch thick. The varying thickness allows the flashing to bend in areas without rippling (i.e., around corners). Transitions between the varying thickness may be gradual or abrupt. The groove may also be a constant thickness. A groove with a constant thickness may be approximately ⅛ inch thick. These dimensions may be adjusted to accommodate flashing of various thickness.

Other embodiments may include an angle that is adjustable to preset degrees. The adjustable angles allow available space on the plate to be conserved. The angle may be adjustable for acute, substantially right and obtuse angles. The adjustment could be set by a variety of ways. For example, block inserts may be added to a portion of the groove, which is shaped to the desired bend. Another example of an adjustable angle may include a pinned guide that assists the flashing in bending only at a certain preset angle.

The present invention also includes a method of forming flashing comprising the steps of (1) obtaining a plate having at least one groove having at least one angle, and a length of flashing; (2) securing the plate; (3) threading the first end of the flashing into the groove by bending the first end to fit the groove, and placing the first end at least partially through the groove; and (4) pulling the first end through the groove and away from the plate, until the desired length of flashing has been formed. After the desired length of flashing has been formed, the flashing would be cut just before or after the plate. Thus, the flashing is bent along the entire length of the piece. The step of cutting the length of flashing after a formed portion has been created to release the length of flashing from the plate is a further step which may be further included to the method of forming flashing. The flashing may also be cut before inserted into the device so that the bend is formed on a precut length.

The step of securing the plate could be further defined as fixedly attaching the plate to a stationary structure. However, other means for securing the plate may be achieved. For example, the plate may be attached to a temporary support, persons holding the plate or some other means for supporting the plate known to one skilled in the art.

Another embodiment may include a guide for assisting the placement of the flashing in the groove. Additionally, the method would further comprise the step of placing a guide slidably attached to said groove against said length of flashing. This guide allows the bend in the flashing to be an even distance from one edge of the sheet metal.

Another embodiment of the present invention includes a step of adjusting an angle on the groove to acquire a desired shape of the flashing. For example, an angle may be adjusted by inserting preshaped blocks in the device to obtain a desired angle, moving a guide to assist the flashing through a certain angle, or adjusting the angle by some other means known to one skilled in the art.

Further objects and advantages of this invention will be more clearly apparent during the course of the following description, references being had to the accompanying drawings which illustrate a preferred form of the device of the invention and wherein like characters of reference designate like parts throughout the drawings.

DETAILED DESCRIPTION OF THE PREFERRED EMBODIMENTS

For the purposes of promoting an understanding of the principles of the invention, references will now be made to the preferred embodiment of the present invention as illustrated in FIGS. 1–11, and specific language used to describe the same. It will nevertheless be understood that no limitation of the scope of the invention is thereby intended. The terminology used herein is for the purpose of description and not limitation. Any modifications or variations in the depicted method or device, and such further applications of the principles of the invention as illustrated therein being contemplated as would normally occur to one skilled in the art to which the invention relates.

Figure 1:
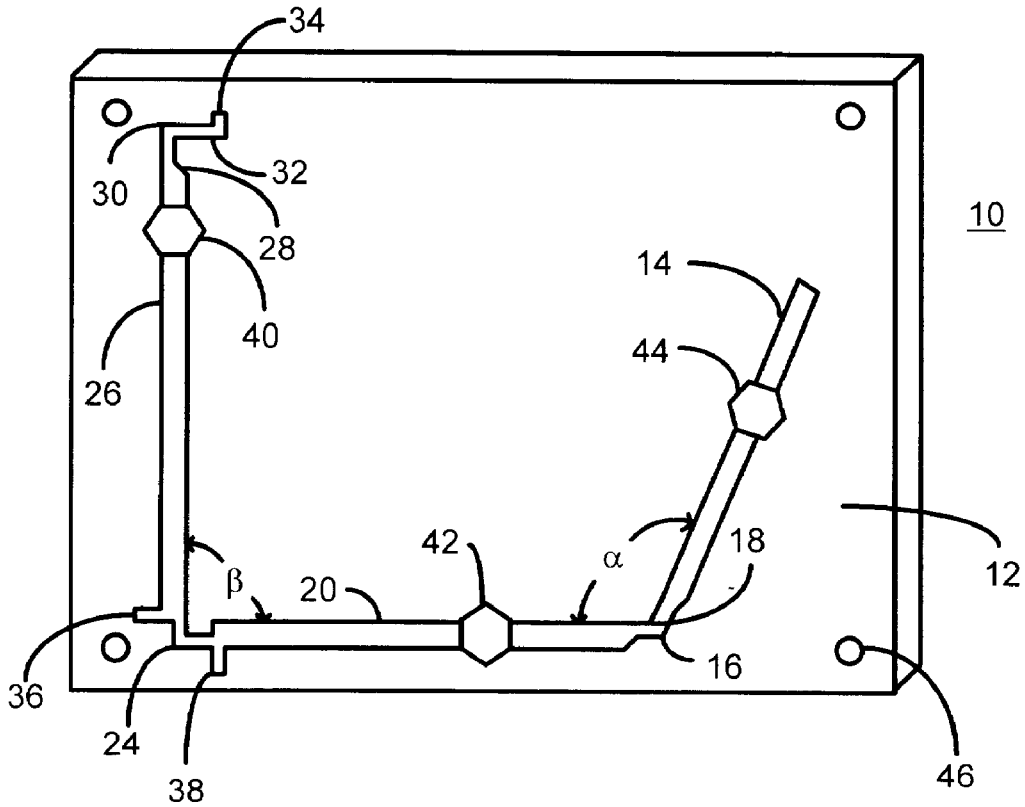
FIG. 1 is a perspective front view of a device for forming flashing that is constructed in accordance with the present invention.

Referring now to FIG. 1, there is shown a front view of a preferred embodiment of the device 10 for forming flashing. The device 10 is a plate 12 having grooves 14, 20, and 26 cut through it. The plate 12 may be manufactured from a material having a sufficiently hard surface to allow the flashing to bend when passed through the groove (e.g., metallic, composite, wood or metallic lined material). The first groove 14 is connected to a second groove 20 at their corresponding ends to form a first bend line 16. The second groove 20 is connected to a third groove 26 also at their ends at a second bend line 24. A first jut groove 38 creates an angle perpendicular to and extending outward from the second groove 20. This first jut groove 38 is located near the second bend line 24. A second jut groove 36 creates a perpendicular angle extending outward from the third groove 26 near the second bend line 24. An extension groove 32 extends out perpendicular to the third groove 26 at a third bend line 30. A third jut groove 34 is located at the end of, and extends outwardly from the extension groove 32 to create a perpendicular angle. Apertures 46 are located around the perimeter of the plate 12 for securing the device 10 to a frame structure.

The first and second groove, 14 and 20 respectively, form an angle β to form a first V-shaped bend in the flashing. The second groove 20, the bend line 24, and the second jut groove 36 form a first Z-shaped bend in the flashing used to fit freeze boards. The second groove 20 and third groove 26 form an angle β to form a second V-shaped bend. The third groove 26, second bend line 24, and the first jut groove 38 form a second Z-shaped bend in the flashing used to fit another type of freeze board. The third groove 26, the third bend line 30, the extension groove 32, and the third jut groove 34 form a third Z-shaped bend in the flashing also used to fit another type of freeze board.

A first guide 40 slides along the third groove 26, and is used to force the flashing to remain within the second or third Z-shaped bend when pulling the flashing through the device 10. A second guide 42 slides along the second groove to force the flashing against the second Z-shaped bend. A third guide 44 slides along the first groove 14 to force the flashing against the second guide 42 to remain within a relative position of the first V-shaped bend. Guides 40 and 42 may be used against each other to force the flashing to remain within the second V-shaped bend.

The thickness of the grooves around the first bend line 16 is reduced at a first reduction area 18. Additionally, a second reduction area 28 reduces the thickness of the grooves around bend line 30. The reduction areas 18 and 28 prevent wrinkling from occurring in the flashing around the bend areas 16 and 30, respectively, by allowing less room for the flashing to move or flow.

Figure 2:
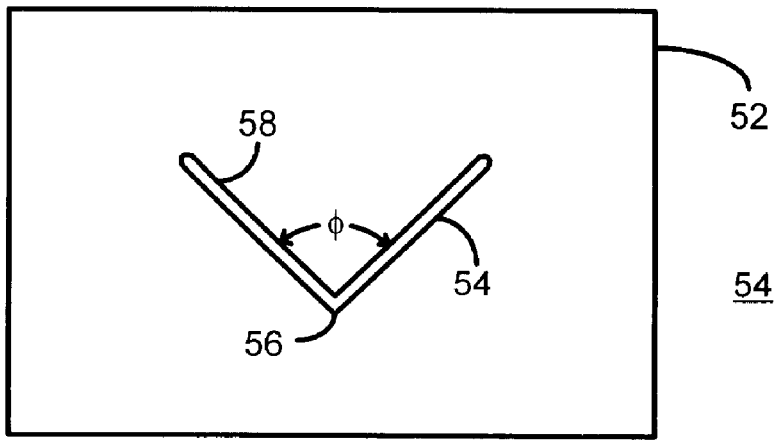
FIG. 2 is a front view of another embodiment of a device for forming flashing that is constructed in accordance with the present invention.

Turning now to FIG. 2, another embodiment of a device for forming flashing 50 is shown from a front view. The device 50 consists of a plate 52 having grooves 54 and 58 cut through the thickness. A first groove 54 is connected to a second groove 58 at a bend line 56. The first and second grooves, 54 and 58 respectively, create an angle Φ about the bend line 56. The first groove 54 and second groove 58 form a V-shaped bend used for forming a single angle along the length of flashing.

Figure 3:
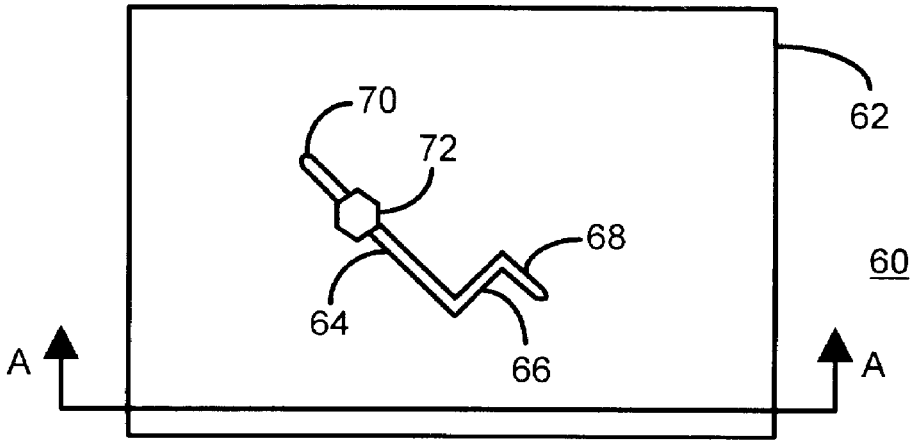
FIG. 3 is a front view of another embodiment of a device for forming flashing that is constructed in accordance with the present invention.
Figure 4:
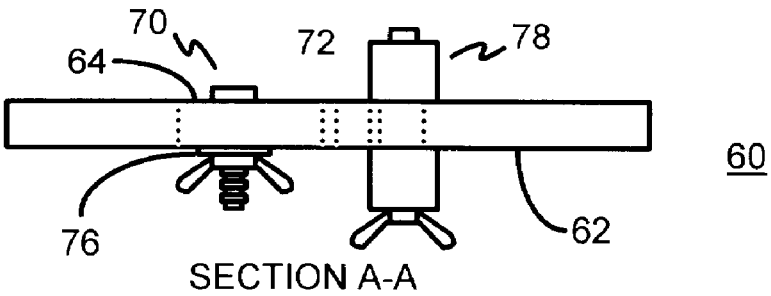
FIG. 4 is a sectional view of the device in FIG. 3.

Referring now to FIGS. 3 and 4, a front and sectional view of another embodiment of a device for forming flashing is shown. The device 60 comprises a plate 62 having a groove 64 and a guide 70. An extension groove 66 is connected substantially perpendicularly to the groove 64 on one end, and a jut groove 68 on the other end. The grooves 64, 66, and 68 are cut through the plate 62. The guide 70 is slidably attached to the groove 64 in such a way that the flashing is forced against grooves 66 and 68 when the guide 70 is positioned next to the flashing. The guide 70 is illustrated as a bolt 72 extending through the plate 62 and attached with a nut 74. A washer 76 allows the guide 70 to be adjusted along the groove 64 without catching. The guide 70 may be loosened or tightened against the plate 62 by adjusting the nut 74. Other guides, having substantially round dimensions and having greater width than a standard bolt head, such as guide 78, may be used. These guides provide additional support for the flashing, especially when forming angles in the flashing having small segments.

Figure 5:
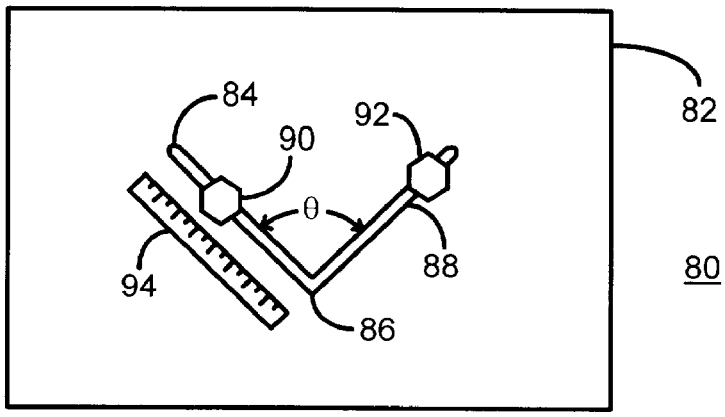
FIG. 5 is a front view of another embodiment of a device for forming flashing that is constructed in accordance with the present invention.

Referring to FIG. 5, a front view of another embodiment of a device for forming flashing is shown. The device 80 is illustrated as a plate 82 having a first groove 84 connected to a second groove 88 at a bend line 86. The grooves 84 and 88 are aligned to create an angle θ, which forms a V-shaped bend. A first guide 90 slides along the first groove 84. Likewise, a second guide 92 slides along the second groove 88. The guides 90 and 92 are used to align a length of flashing in a position about the bend line 86. A scale 94 is attached substantially parallel to the length of the groove 84. A bend crease is measured using the scale 94 to achieve a desired distance from the crease to the edge of the flashing.

Figure 6:
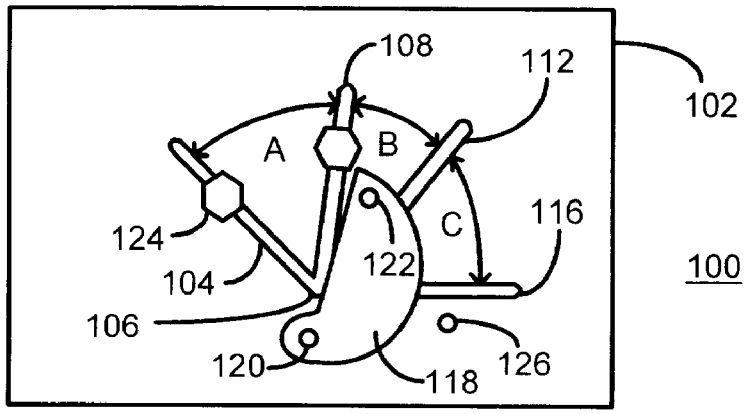
FIG. 6 is a front view of another embodiment of a device for forming flashing that is constructed in accordance with the present invention.
Figure 7:
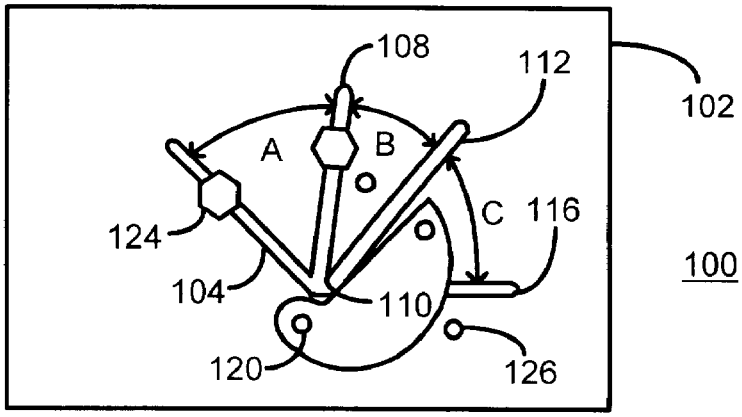
FIG. 7 is a front view of the device in FIG. 6 illustrating an alternative setting for adjusting an angle.

Now turning to FIGS. 6 and 7, another embodiment of a device for forming flashing having an adjustable angle is illustrated in perspective front views. The device 100 comprises a plate 102 having adjustable angle grooves. A main groove 104 is connected to a first groove 108 about a first bend line 106 to create an angle A. Additionally, the first groove 108 is connected to a second groove 112 about a second bend line 110 to create an angle B. Furthermore, the second groove 112 is connected to a third groove 116 about a third bend line 114 to create an angle C. The grooves 104, 108, 112, and 116 are positioned in a fan shaped arrangement having angles A, B and C.

An adjustment guide 118 is attached to the plate 102 with a pinned connection 120. The adjustment guide 118 assists the flashing when using the first and second grooves, 108 and 112 respectively. A removable pin 122 is placed in a first aperture 128, as shown in FIG. 6, when using the first groove 108. The pin 122 is placed in a second aperture 130 (hidden view) when using the second groove 112, as shown in FIG. 7. When using the third groove 116, the pin may be placed in a third aperture 126 to store the adjustment guide 118. A guide 124 is attached to the main groove 124, and slides up against the flashing to hold it in place.

Figure 8:
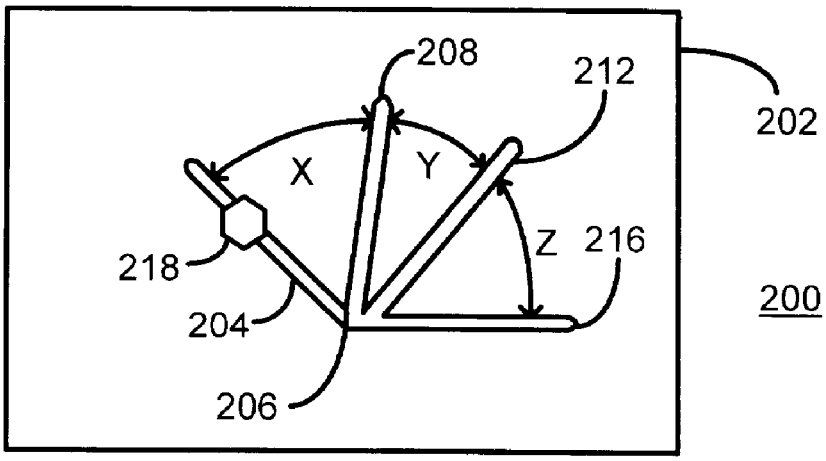
FIG. 8 is a perspective front view of another embodiment of a device for forming flashing that is constructed in accordance with the present invention.
Figure 9:
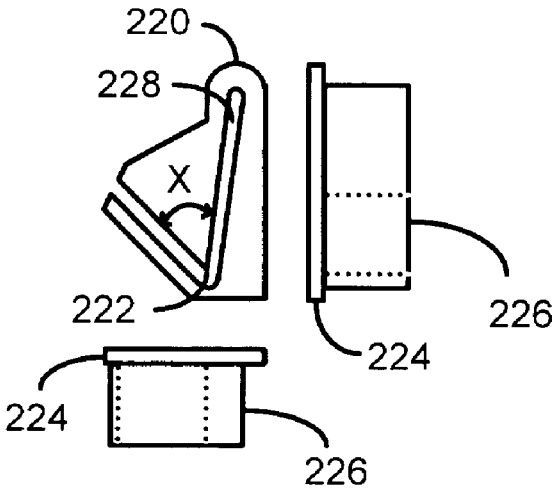
FIG. 9 is a front view of a block for adjusting the angle in the device shown in FIG. 8.
Figure 10:
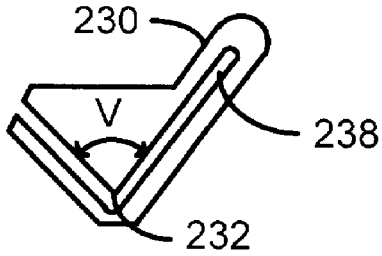
FIG. 10 is a front view of another block for adjusting the angle in the device shown in FIG. 8.
Figure 11:
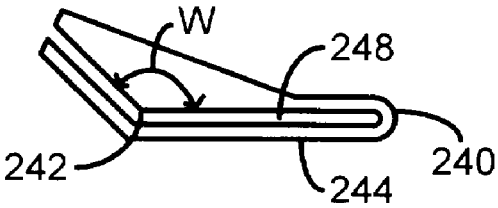
FIG. 11 is a front view of another block for adjusting the angle in the device shown in FIG. 8.

Referring now to FIGS. 8–11, another embodiment of a device for forming to flashing having adjustable angles is illustrated in FIG. 8 as a front view. FIGS. 9–11 show block inserts for the device 200. The device 200 comprises a plate 202 having adjustable angle grooves. A main groove 204 is connected to a first groove 208, a second groove 212, and a third groove 216 at one point forming a fan-like arrangement. The main groove 204 is connected to a first groove 208 about a first bend line 206 to create an angle X. Additionally, the first groove 208 is connected to a second groove 212 about a second bend line 210 to create an angle Y. Furthermore, the second groove 212 is connected to a third groove 216 about a third bend line 214 to create an angle Z. A guide 218 is attached to the main groove 204, and slides up against the flashing to hold it in place.

A first block 220 consists of an insert 226 and a web 224. The first block 220 is arranged to fit into the first groove 208 and the main groove 204, whereas an insert groove 228 is substantially the same. An insert bend line 222 is substantially the same as the first bend line 206. Thus, an angle X is achieved in the first block 220 which follows the angle X on the plate 202. A second block 230 also consists of an insert 236 and a web 234. The second block 230 is arranged to fit into the second groove 212 and the main groove 204, whereas an insert groove 238 is substantially the same. An insert bend line 232 is substantially the same as the second bend line 210 added to the first bend line 206. Thus, an angle V is achieved in the second block 230, which follows the angle X, plus Y on the plate 202. A third block 240 also consists of an insert 246 and a web 244. The third block 240 is arranged to fit into the third groove 216 and the main groove 204, whereas an insert groove 248 is substantially the same. An insert bend line 242 is substantially the same as the third bend line 214 added to the first and second bend line, 206 and 210 respectively. Thus, an angle W is achieved in the third block 240, which follows the angle X, plus Y and Z on the plate 202. Each insert must be used independent of the others. The inserts may be used as a wear piece and replaced as a separate unit.

Although a specific form of the invention has been illustrated and described, it will be apparent that various modifications can be made without departing from the spirit and scope of the invention.

What is claimed is:

1. A device for forming flashing comprising:

a plate;

at least one groove cut through said plate having at least one angle to change said groove from a first direction to a second direction on said plate; and at least one adjustable guide slidably attached to said groove.

2. The device of claim 1 wherein said adjustable guide comprises a bolt and a nut.

3. The device of claim 1 further comprising a measuring means in-line with said groove.

4. The device of claim 1 wherein said angle forms a substantially Z-shaped groove.

5. The device of claim 4 wherein said angle is sized to form said flashing to an applied window casing.

6. The device of claim 4 wherein said angle is sized to form said flashing to an applied door casing.

7. The device of claim 4 wherein said angle is sized to substantially fit a three-quarter inch window and freeze board flashing.

8. The device of claim 4 wherein said angle is sized to substantially fit a one-inch freeze board flashing.

9. The device of claim 4 wherein said angle is sized to substantially fit a five-quarter inch freeze board flashing.

10. The device of claim 1 further comprising at least one aperture around the perimeter of said plate.

11. The device of claim 1 further comprising a means for attaching said plate to a frame structure.

12. The device of claim 1 wherein said groove varies in thickness.

13. The device of claim 12 wherein said groove varies between approximately ⅛ inch thick to approximately 1/16 inch thick.

14. The device of claim 1 wherein said angle is adjustable to preset degrees.

15. A method of forming flashing comprising:

(a) obtaining a plate having at least one groove comprising at least one angle, and a length of flashing having a first end;

(b) placing a guide slidably attached to said groove against said length of flashing;

(c) securing said plate;

(d) threading said first end into said groove by bending said first end to fit said groove, and placing said first end at least partially through said groove; and (e) pulling said first end through said groove and away from said plate, until a desired amount of said length of flashing has been formed.

16. The method of claim 15 further comprising the step of adjusting an angle on said groove to acquire a desired shape of said length of flashing.

17. The method of claim 15 further comprising the step of cutting said length of flashing after a formed portion has been created to release said length of flashing from said plate.

18. The method of claim 15 wherein said step of securing said plate comprises fixedly attaching said plate to a stationary structure.

* * * * *